US006865769B1

(12) United States Patent
Sorenson

(10) Patent No.: US 6,865,769 B1
(45) Date of Patent: Mar. 15, 2005

(54) PAINT EDGER WITH IMPROVED PAD AND PRECISION POSITIONING ADJUSTMENT

(75) Inventor: Gregg R. Sorenson, West Allis, WI (US)

(73) Assignee: Gerhard-Sorenson, Lake Geneva, WI (US)

( * ) Notice: Subject to any disclaimer, the term of this patent is extended or adjusted under 35 U.S.C. 154(b) by 282 days.

(21) Appl. No.: 09/597,320

(22) Filed: Jun. 19, 2000

Related U.S. Application Data

(60) Division of application No. 08/953,061, filed on Oct. 20, 1997, now Pat. No. 6,076,225, which is a continuation-in-part of application No. 08/538,362, filed on Oct. 3, 1995, now Pat. No. 5,678,277.

(51) Int. Cl.[7] ..... A47L 13/16; B05C 17/00
(52) U.S. Cl. ..... 15/210.1; 15/230; 15/244.1
(58) Field of Search ..... 15/244.1, 244.4, 15/230, 210.1

(56) References Cited

U.S. PATENT DOCUMENTS

| | | | | |
|---|---|---|---|---|
| 2,227,588 | A | * | 1/1941 | Kemp |
| 2,378,900 | A | | 6/1945 | Adams |
| 2,582,861 | A | | 1/1952 | Coombs |
| 2,644,186 | A | | 7/1953 | Guimond |
| 2,659,917 | A | | 11/1953 | Drum |
| 2,680,318 | A | | 6/1954 | Simmons |
| 2,732,574 | A | * | 1/1956 | Gesell |
| 2,779,960 | A | | 2/1957 | Ogren |
| 2,798,239 | A | | 7/1957 | Freund |
| 2,810,148 | A | | 10/1957 | Wood, Jr. |
| 2,816,308 | A | | 12/1957 | Schultz |
| 2,829,393 | A | * | 4/1958 | Turcotte |
| 2,936,474 | A | | 5/1960 | Custer |
| 2,959,800 | A | | 11/1960 | Bischoff |
| 2,961,677 | A | * | 11/1960 | Zecchini |
| 2,975,453 | A | | 3/1961 | Imhof |
| 2,985,902 | A | | 5/1961 | Sopocy |
| 3,038,187 | A | * | 6/1962 | Nathanson |
| 3,359,589 | A | | 12/1967 | Moore |
| 3,448,722 | A | | 6/1969 | Krizman |
| 3,605,165 | A | | 9/1971 | Burns |
| 3,629,894 | A | | 12/1971 | Stefany |
| 3,694,845 | A | * | 10/1972 | Engelsher |
| 3,708,821 | A | | 1/1973 | Chase et al. |
| 3,736,616 | A | | 6/1973 | Seip |
| 3,886,621 | A | | 6/1975 | Welsh |
| 3,938,686 | A | | 2/1976 | Milligan et al. |
| 4,091,493 | A | | 5/1978 | Weiss |
| 4,145,789 | A | | 3/1979 | Morgan, Sr. |
| 4,233,705 | A | | 11/1980 | Lepage et al. |
| 4,300,258 | A | | 11/1981 | Burns et al. |
| 4,315,342 | A | | 2/1982 | Ash |
| 4,402,102 | A | | 9/1983 | Al-samman |
| 4,424,603 | A | | 1/1984 | Balint et al. |
| 4,611,941 | A | | 9/1986 | Karliner et al. |
| 4,665,580 | A | * | 5/1987 | Morris |
| 4,729,143 | A | | 3/1988 | Dawson |
| 4,852,201 | A | | 8/1989 | Wundrock et al. |
| 4,852,203 | A | | 8/1989 | LaBelle |
| 4,872,236 | A | | 10/1989 | Thompson |

(List continued on next page.)

FOREIGN PATENT DOCUMENTS

| | | |
|---|---|---|
| BE | 533467 | 12/1954 |
| CH | 13886 | 3/1897 |
| GB | 1521173 | 8/1978 |

*Primary Examiner*—Randall Chin
(74) *Attorney, Agent, or Firm*—Vedder Price Kaufman & Kammholz

(57) ABSTRACT

Various paint applicator pads are disclosed. These include a pad with a tapered edge for applying paint, and those having a generally convex body with a stiff backing portion. These pads include those with two layers of different porosity foams. Preferably, these pads are rotary pads for use with a spindle.

4 Claims, 9 Drawing Sheets

U.S. PATENT DOCUMENTS 5,134,745 A 8/1992 Burns et al.
5,209,781 A 5/1993 Milkie
5,240,339 A * 8/1993 DeForest
5,244,090 A 9/1993 Keith
5,267,369 A 12/1993 O'Neil et al.
5,311,634 A * 5/1994 Andros
5,361,442 A 11/1994 Payne et al.
5,640,737 A * 6/1997 Boggs

* cited by examiner 232
230
200
236
234
234
236
222
212
214
216
228
222
220
218
214
216
208
202
210
204
206

224
222
232
208
226

228
225
227
232
208
231
229

250
211
252
248
246
247
244
"P"
238
240
242

PAINT EDGER WITH IMPROVED PAD AND PRECISION POSITIONING ADJUSTMENT

This application is a divisional of application Ser. No. 08/953,061, filed on Oct. 20, 1997, now U.S. Pat. No. 6,076,225 which is a CIP of application Ser. No. 08/538,362, filed on Oct. 3, 1995, now U.S. Pat. No. 5,678,277.

BACKGROUND OF THE INVENTION

The present invention relates generally to various specialty apparatus for painting, and more particularly, to an apparatus for precisely controlling the application of paint to edges, corners, or like margins of painted surfaces. In particular, the apparatus uses one, and in some cases, two or more separate features in order to insure that a painted edge formed by using the device will lie along a very exact locus so as to provide a high quality appearance in the finish painted surface. The invention also relates to specialty trays or pans for paint applicators.

One appliance of the invention is particularly adapted for use with so-called thixotropic paints of the type normally applied by roller as well as brush, most or all of such paints being of the emulsion or water dilutable type.

In the past, it has been customary, when painting interior and exterior surfaces, such as walls and ceilings, to apply the major portion of the surface covering using a paint roller. Whether or not a roller is used on the major parts of the wall surface, it is almost always desirable to carry out the edging process as precisely and quickly as possible in order to impart a high quality appearance to the finished room, wall panel or the like. As those familiar with painting are aware, the process or edging or "blocking out" an area such as an interior room, to be painted, often requires much more care and effort than painting the larger areas of the room. "Blocking out" consists of forming a band of paint around all the outer margins of a room, such as where a wall meets a ceiling, where a wall or ceiling meets trim, such as door and window trim, wainscoting or the like. The trim edge of this band of paint must be precisely formed. As used herein, "trim edge" means a hard edge, to one side of which is a full layer of paint, with none on the other side. A "feather edge" occurs on the opposite side of the band of paint; as used here, "feather edge" means a blended marginal area at which the contrast between painted and unpainted areas is slight and the separation between painted and unpainted areas is an irregular and feather-like locus rather than a straight, distinct line. If the hard or trim edge portion to be painted is at the junction of adjacent walls, or a wall and a ceiling, a wavy or meandering edge will create a low quality appearance. If the area to be painted includes an edge or margin bounded by wood or other trim, a poorly applied edge will result in spattering or coating the trim with paint, or leaving unsightly gaps between the trim and the paint.

One of the problems with prior art pads is that, where their manipulation requires excess time to be taken during the "blocking out" operation, the band of paint takes on an initial set or cure, leaving a sharp, visible edge where the blocked out areas terminate at an unpainted area. Therefore, when the remainder of the area is painted with a brush or roller, this line is visible upon close inspection, and this causes the job to take on an overall appearance of diminished or compromised quality.

Until the present time, such edging has been carried out to a minor extent by brushes, usually a very fine tip or point brush, and to a much greater extent by specially designed edger apparatus. Ordinarily, these are in the form of a simple, rectangular block of paint-absorbent material carried on a rigid backing and including a pair of spaced apart contact points such as feet or rollers that are intended to roll or rub along the edge of an adjacent surface. Such edging devices are inexpensive and in common use, but they suffer from several drawbacks.

The first of these is that, ordinarily, the rollers or the like which are intended to engage an adjacent surface are of small diameter and sometimes difficult to roll. There is rarely provided a satisfactory adjustment system that permits the edge portion of the pad to be precisely positioned relative to the outer diameter of the rollers. No such system is known to applicant wherein the edge location can be adjusted instantaneously or "on the fly" in the use of the device. Where minor irregularities exist in the adjacent surface, it is possible for the wheels of prior art devices to follow the surface to an excessive extent, thereby rocking and creating unsightly, wavy margins resulting from the shape of the surface engaged by the wheels that locate the pad.

It is also common for known paint edgers to include wheels or rollers having a relatively large contact surface and which are therefore susceptible to transferring paint to an adjoining surface used as a guide if the wheels themselves become contaminated with paint when the edger is dipped in the paint supply vessel. Such contact, while undesirable, is often almost inevitable in view of the manner in which most prior art devices are constructed and arranged. Specifically, the guide rollers form a part of a frame which is positioned almost immediately adjacent the pad, creating a substantial risk of paint pickup.

Prior paint edgers in use usually include a fixed relation between the pad location and that of the wheels. Therefore, if this location is adjustable between uses, when the desired appearance is not created, the entire apparatus must be removed and readjusted before another pass can be made to provide a more precise location of the edge area.

The construction and arrangement of prior art application pads was such that there were many areas for improvement. For example, many of the pads lack substantial paint capacity, and were arranged such that regardless of the capacity, there was no effective mechanism for transferring paint from a remote portion of the pad surface to the edge where the paint was desired to be applied.

In other application arrangements and systems, the paint application pad often lacked thicknesses and proper contour and in some cases, had insufficient stiffness adjacent its edge to permit a fine line, hard-edge type application of paint to the desired area along a carefully controlled line while creating a feather edge in a spaced apart area.

Still further, many if not all prior art pads suffered from difficulty when it was attempted to till them with paint, either by reason of the pad construction or by reason of the tray or other paint receptacle with which the pad was required to cooperate during the paint pickup operation.

In addition to the difficulties with prior art paint edgers, paint trays or holders of various configurations have also suffered from drawbacks which has compromised their ability to be used in the most effective way with paint applicators such as edgers and rollers. For example, dipping prior art paint edgers into an open tray has been difficult because of the thin cross section of the paint receiving pad and the need to position the pad evenly and precisely within the tray or other receptacle.

Paint trays generally, whether of the type adapted to receive a roller or to be used in filling an edging device, do not successfully confine the paint against surging or slashing, and yet require the roller to be squeezed against the flat surface to prevent overloading of the roller with fresh paint. Ordinary paint trays are also susceptible to accidental spillage, either by reason of being kicked or bumped or in use, or by being placed on an unduly slanted surface or the like.

An ideal paint tray would have a large capacity but not be susceptible to ready spillage, and furthermore, would facilitate loading of any painting device without difficulty. Still further, an ideal paint tray or receptacle would be capable of easy cleanup after use to facilitate reuse. Yet another ideal paint tray would assist in the uniform application of paint to a roller or other applicator, regardless of the texture or makeup or such roller, pad, or other applicator.

A further ideal paint tray would be one which would possess a number, such as two or three, of removable and replaceable foam inserts, one for each type of paint being used, with or without an impermeable cover.

A still further ideal paint tray would be one which would include a cover for the entire assembly, whereby a roller could be left in the paint tray after use and would not dry out or require cleaning for an extended time.

Yet another ideal paint tray would be one in which the paint tray was relatively permanent but which included an insert for the tray. Optionally, this insert could have a foam cover bonded thereto.

Still another ideal paint tray would include a piece of foam simply adhered to a portion of the bottom wall thereof, or having such a piece of foam bonded to a portion of the bottom wall of a tray insert, whereby the tray could be made to serve any number of times.

In view of the foregoing and other drawbacks of existing paint edgers, it is an object of the present invention to provide an improved paint edger.

A further object of the invention is to provide an improved tray or receptacle for retaining paint and applying it to rollers, pads or other applicators.

Yet another object of the invention is to provide a paint pad that has a contoured or dished center section as well as an outer margin portion formed in part by a contoured backer with a sharp edge or other contoured edge designed to contact or approach a reference surface in a desired manner.

Another object of the present invention is to provide an apparatus wherein the application pad is of substantially increased size and capacity relative to similar prior art pads.

Still another object of the invention is to provide a paint receptacle for use with an edger, which receptacle can effectively contain a larger supply of paint than prior art devices and yet permit the paint to be applied in a simple and reliable manner, such apparatus comprising a receptacle and a porous foam insert providing several advantages in use.

A further object of the invention is to provide a paint edger wherein the paint pad is mounted for rotation about an adjustably positionable axis.

A still further object of the invention is to provide a paint edging apparatus wherein a rotary edge locating disc may optionally include spurs or points rather than a flat surface for contacting the wall or like adjacent surface to locate the disc.

Yet another object of the invention is to provide an edging apparatus that includes a handle including an exterior gripping surface, a rotary locating disc, and an application pad of circular outline, and having a desired cross-sectional body contour and a relatively stiff but resilient backing element.

A further object of the invention is to provide an improved edger wherein a pair of spindles are eccentrically arranged and axially offset from each other to permit the user to position the pad edge with any desired degree of proximity to an adjacent surface or other guide.

Another object of the invention is to provide a paint edger accessory which includes a handle with a fixed backing plate, a rotary locating disc having an outer surface intended for contact with a guide surface and a intermediate, radially resilient section, whereby radial force applied to the handle will cause the pad to more closely approach or depart from the guide surface.

Still another object of the invention is to provide a paint edger having a contoured pad with a sharp-edged backing or stiffener that includes a contour providing an edge area of substantially red-iced cross-section and wherein the paint pad includes a dished or bowed appearance when viewed in cross-section as to permit the apparatus to be tilted relative to its rotary axis for greater user control and creation of a strip of paint having a soft or feather edge along one side and a hard edge on the opposite side.

A further object of the invention is to provide an apparatus for applying paint to an edge, such apparatus being able to be manufactured at low cost and providing a high degree of accuracy and reliability in use.

A still further object of the invention is to provide a paint edging apparatus wherein the operating handle may be rotated so as to position the edge locating disc a desired but variable distance from an adjacent guide surface.

An additional object of the invention is to provide a paint edger or like apparatus having a novel combination of features including a radially flexible locating disc that is optionally usable in combination with an eccentric spindle for a locating disc whereby the associated paint pad may be held in a desired position relative to a base line depending on the force applied by the user.

Yet another object of the invention is to provide a paint edger wherein the rotary locating disc includes an outer periphery with spurs or points, a center opening, and a plurality of spring fingers formed between spiral grooves to permit the locating disc to flex radially in response to an applied pressure.

A further object of the invention is to provide a paint pad made from two or more separate materials laminated together so as to facilitate paint retention as well as the ability to control application of paint along a desired locus, particularly at the feather edge of the pad.

Another object of the invention is to provide an edger apparatus with a rotary paint pad having a plurality of wells or like cylindrical openings to increase the capacity of the pad.

Still another object of the invention is to provide a combination rotary pad or roller and an improved paint pickup or transfer dish adapted to apply paint to the pad or roller with greater ease and uniformity.

Another object of the invention is to provide a paint tray with a variety of foam-type pads.

Yet another object of the invention is to provide a paint tray with an impermeable cover, and having a small opening sized so as to allow the shank portion of a roller to fit therethrough, either alone or in combination with one or more removable pads for the top thereof.

Still another object of the invention is to provide such a tray and pad arrangement that would be easily attachable to and removable from the tray.

A further object of the invention is to provide a foam pad that is capable of attachment to a tray by reason of including at least two, and preferably four, sides with an embedded or otherwise attached elastic band around the pad to facilitate attachment thereof to the paint tray.

A still further object of the present invention is to provide a tray liner assembly including a liner portion and a pad bonded thereto around the outer margins of the tray, whereby the tray and insert and the foam pad may be discarded after use without affecting the tray.

An additional object of the invention is to provide a paint tray or a paint tray liner having a foam pad adhered to a portion of the bottom surface thereof in order to improve rollout and paint pickup by reason of engagement between the pad and the roller.

The foregoing and other objects and advantages of the invention are achieved in practice by providing a paint edger apparatus including a handle assembly with a fixed backing plate, and a pair of spindles, one for a locating disc and the other for a rotary paint pad, and a paint pad having a contoured cross-section and a pad stiffener element, and with the locating disc including helical fingers defined by arcuate slots forming an intermediate section to provide radial resiliency in use such that the user may approach a desired edge line to any desired degree.

The objects of the invention are also achieved by providing an edging pad of a particular construction including desired, sharp-edged outer margin and a composite body constructed from foam components of different porosities.

The invention also achieves its objects by providing an edger as just described that further includes an eccentric or offset mounting of the pad spindle relative to the locating disc spindle, and by providing a paint tray having various advantages in use. Still further, the objects are achieved by providing a tray of improved construction that is useful with applicators of various types, such as pads or rollers.

The manner in which the foregoing and other objects and advantages are achieved in practice will become more clearly apparent when reference is made to the following detailed description of the preferred embodiments of the invention set forth by way of example and shown in the accompanying drawings wherein like reference numbers indicate corresponding parts throughout.

DESCRIPTION OF THE PREFERRED EMBODIMENTS OF THE INVENTION

While the apparatus of the invention may be embodied in various forms, a description of several presently preferred embodiments will be given to illustrate the invention. It will be understood that a number of modifications in materials, dimensions, and arrangement of parts may be made, if this is desired for some purpose, and that various novel features may be combined in different ways and further, that some features may be omitted if desired.

Figure 1:
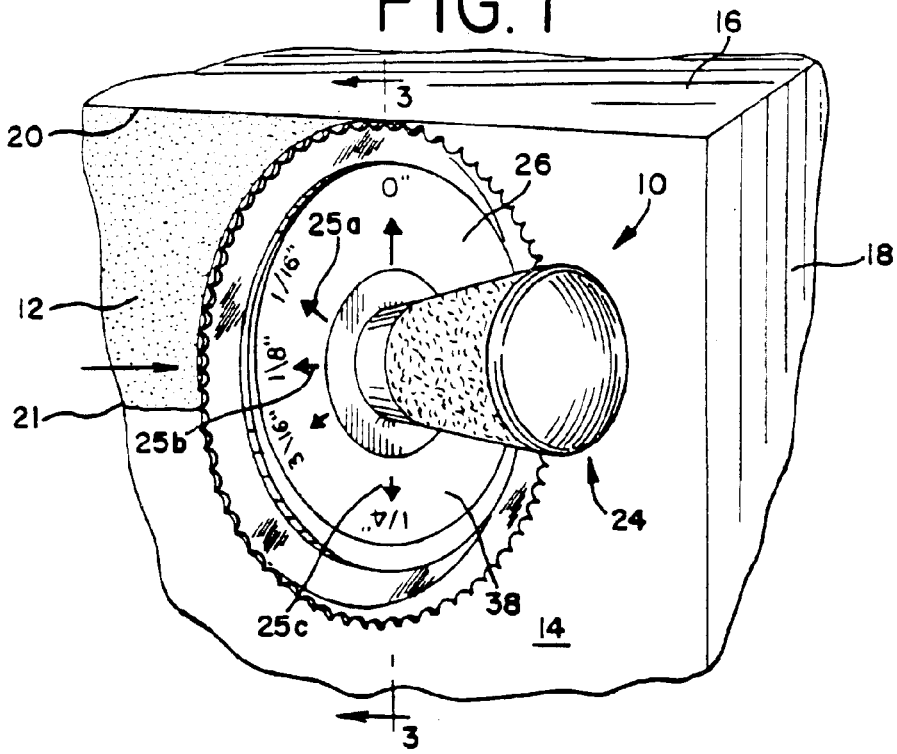
FIG. 1 is a perspective view of the paint edger apparatus of the invention, showing the same in applying paint to a wall bordered by an adjacent ceiling.

Referring now to the drawings in greater detail, FIG. 1 shows an apparatus generally designated 10 to be applying a layer or coat of paint 12 on a vertical wall surface 14 which, for purposes of illustration, has edges meeting a ceiling 16 and an adjacent wall 18.

Figure 10:
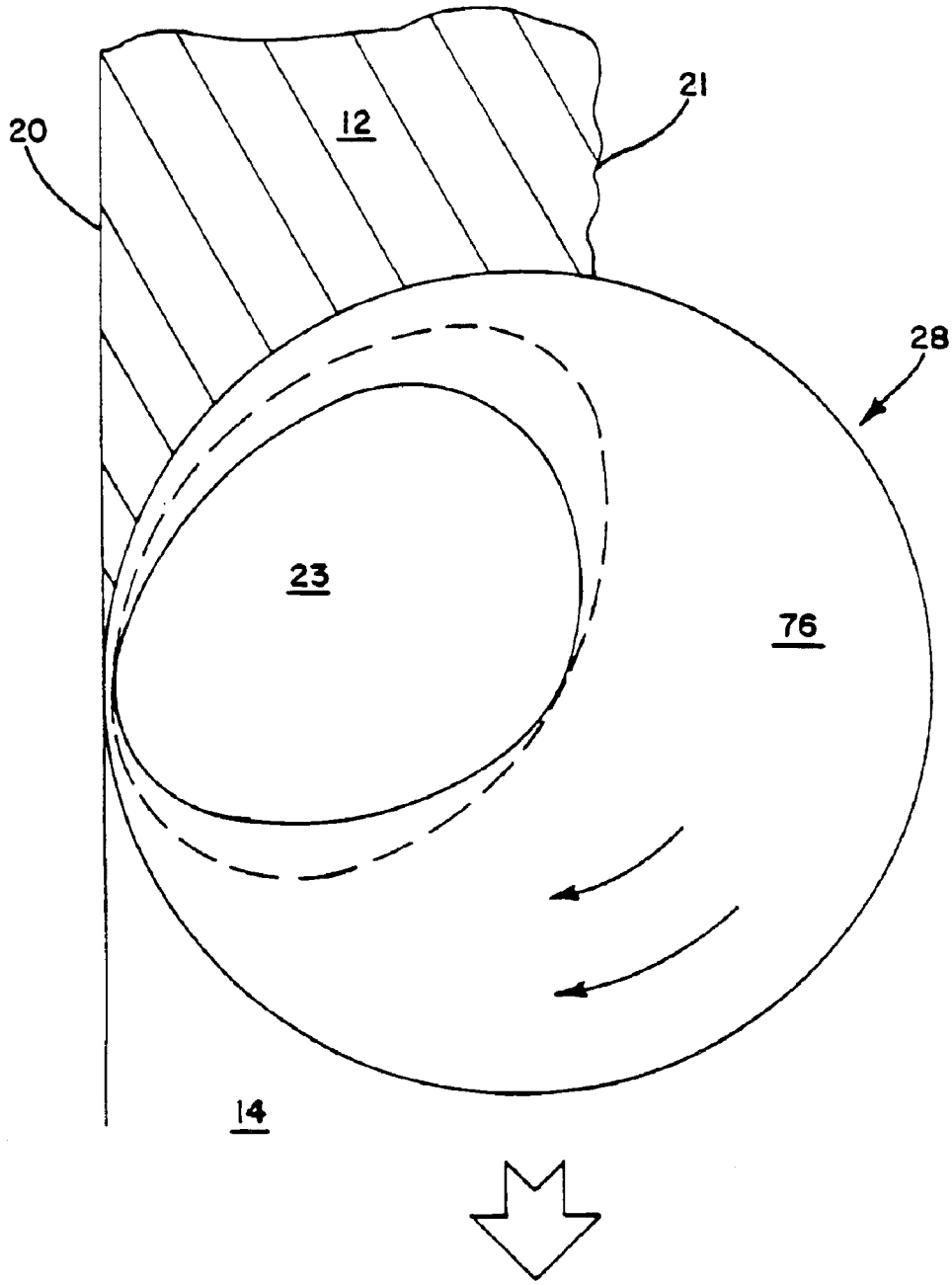
FIG. 10 is a diagrammatic bottom plan view of the edger device of the invention, showing the application area, the hard and feather edge areas and the rotary action in transferring paint from storage area of the pad towards the application area as the pad rotates about its axis.

According to the invention, it is desired to apply the paint in a smooth, even coat wherein the so-called "hard edge" or "trim edge" 20 of the painted surface will closely approach or exactly coincide with the edge 22 of the adjacent surface, in this case the ceiling 16, and wherein a "feather edge", soft or blended edge 21 will be created parallel to and opposite the trim edge 20 (FIGS. 1 and 10).

According to one presently preferred embodiment of the invention, the apparatus 10 includes a handle generally designated 24, a rotary locating disc generally designated 126, and a paint applicator pad generally designated 28.

Figure 2:
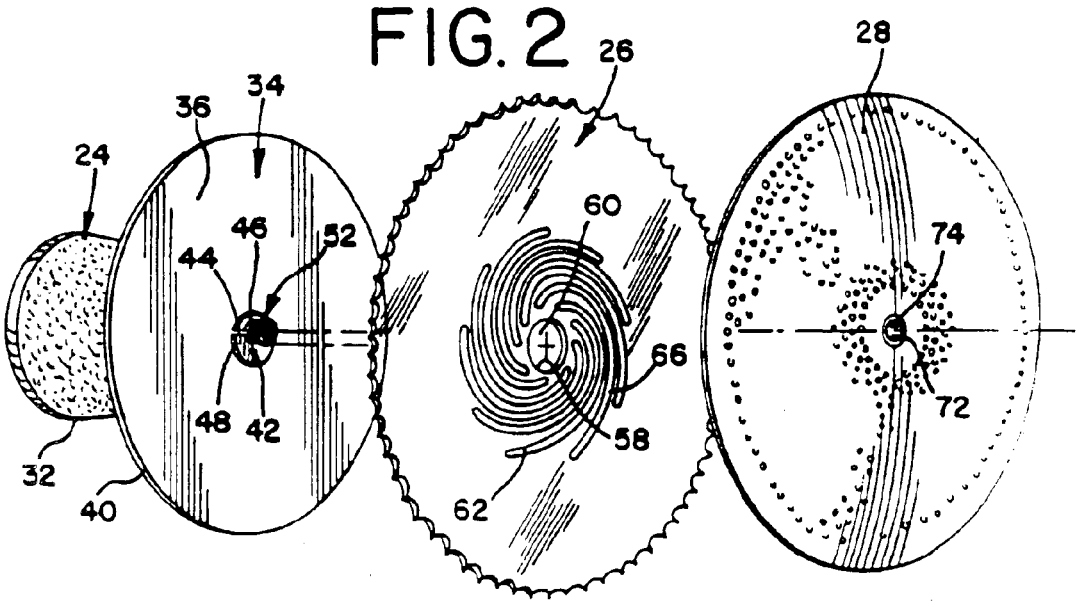
FIG. 2 is an exploded perspective view of the principal components of the invention, namely, the paint application pad, the rotary locating disc, and the handle assembly with a pair of eccentric spindles on a relatively rigid backing plate.
Figure 4:
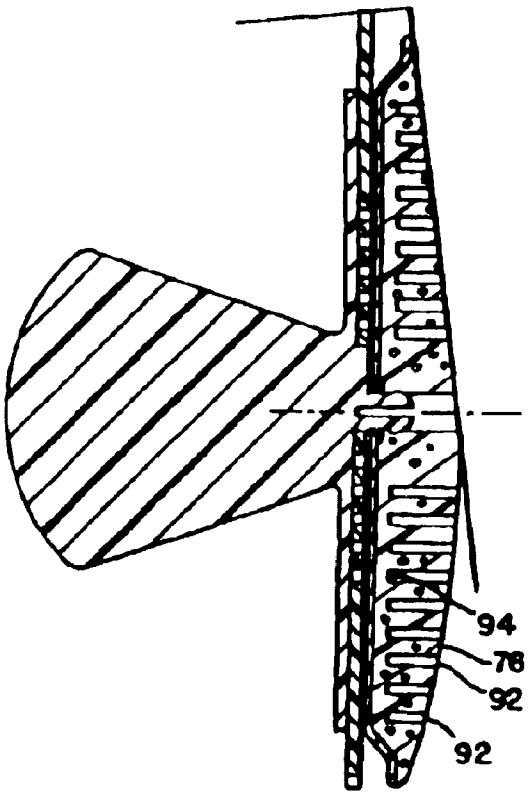
FIG. 4 is a vertical sectional view of the pad of FIG. 3, showing the unit in a position wherein the pad edge is spaced well apart from the guide or edge surface.
Figure 3:
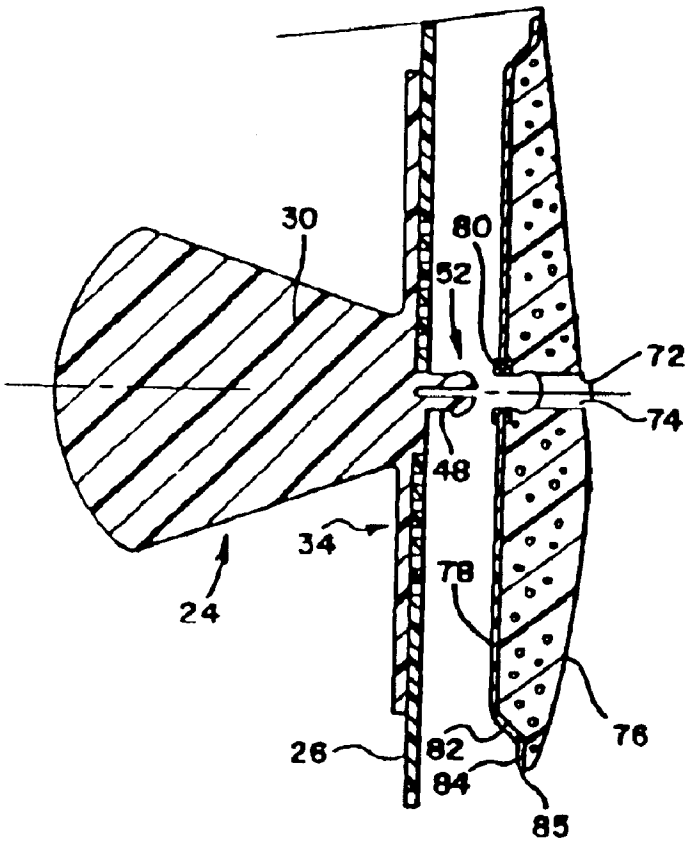
FIG. 3 is an exploded vertical sectional view of the paint pad apparatus of the invention shown in one position of use, with the pad adjacent the guide or locating surface.
Figure 5:
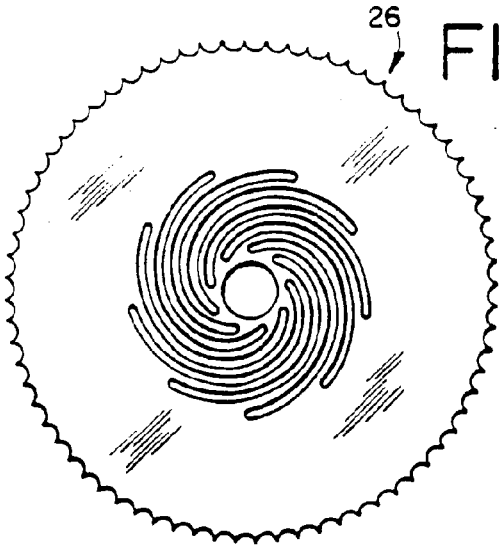
FIG. 5 is a plan view of one form of rotary locating disc of the apparatus, showing the same in an unstressed condition.
Figure 6:
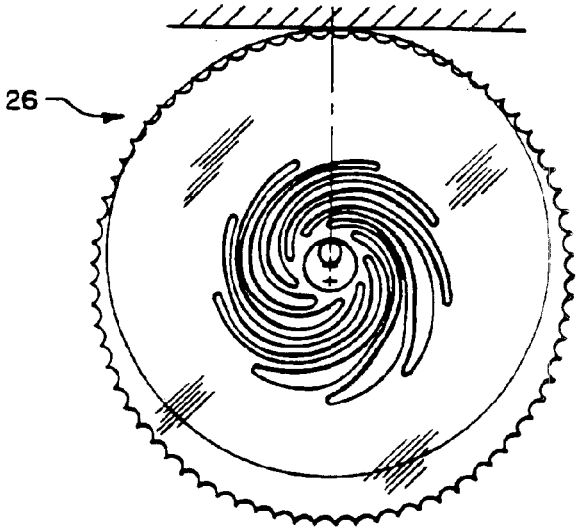
FIG. 6 is a view similar to that of FIG. 5, but showing the disc in a radially distended or flexed position.

As shown in FIGS. 2–4, the handle assembly 24 includes a body portion 30 (FIG. 3) and a preferably textured exterior gripping surface 32, and a comparatively rigid backing plate generally designated 34 and shown to include a front or disc support surface 36, a rear or display surface 38 (FIG. 1), and an outer edge portion 40.

According to the invention, the backing plate 34 extends radially outwardly enough to provide virtually full backing to the body of the application pad 28, but not go far as to interfere with the gauging function of the locating disc 26.

Referring again to FIG. 2, the handle assembly 24 is shown to include on the front surface 36 of the backing plate 34 a larger diameter, axially inner (toward the handle) spindle 42 having a shallow cylindrical bearing surface 44. Located coaxially with the handle 24 is a second, reduced diameter spindle 46 having a radially outer bearing surface 48 (FIG. 3) and an enlarged head portion generally designated 52. As best shown in FIG. 3, the smaller spindle 46 is comprised of a plurality of segments 48 separated by a slot 50, with portions of each of the segments 48 forming the head 52 that provides a snap-in action for the paint applicator pad as will appear.

Referring now to the rotary gauging or locating disc 26 shown in FIGS. 2 and 5–7, this element preferably comprises a flat piece of plastic or like comparatively rigid material. In one form, the disc 26 includes an outer margin 54 having a plurality of spurs 56, the tips of which are adapted to roll along a contact or gauging surface such as that of the ceiling 16 in FIG. 1. Preferably, the plastic material is hydrophobic, so that paint will not wet or remain on the spurs, due to the surface tension of the liquid.

According to one presently preferred form of the invention, the rotary locating disc 26 also includes an inner web 58 having an edge defining a center opening 60. Spaced just radially outwardly of the center opening are a plurality of helical or arcuate slots 62 that begin near the web 58 adjacent the center opening 60 and extend gradually around and outwardly towards the middle portion of the disc 26. The slots 62 create a series of fingers 66 that also extend from the mid-section portion of the disc into and merge with the web area 58 near the center opening 60.

Figure 7:
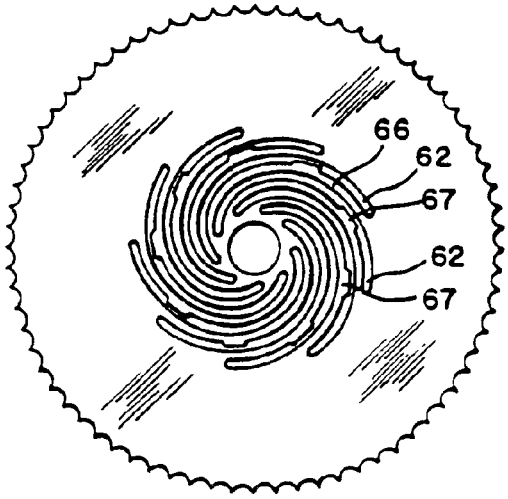
FIG. 7 is a plan view of a disc similar to that of FIG. 5, but showing modifications to the fingers providing a modified form of radial resilience for the locating disc.

FIG. 7 shows that the fingers 66 which combine with the slot 62 to form an area of defined radial weakness are of a modified construction. Here, each of the fingers 66 includes a stop element 67 of increased width relative to the remainder of the finger 66. Accordingly, the effective width of the slots 62 separating the fingers is reduced. For purposes that will appear, upon radial distortion of the disc, the generally radial travel of the fingers before they reach a "solid height" is reduced in the area of these stop elements 67.

Regarding the composition of the guide or locating disc 26, for purposes of extended wear, physical strength, and its resilience in providing a spring section for the disc center, this unit is preferably made from polycarbonate plastic. In such case, the points or spurs may damage an adjacent wall surface if it is extremely delicate. Consequently, the points or spurs 56 may be formed with somewhat rounded end or tip portions. These tips can also be radially inclined instead of extending in a pure radial direction. The disc 26 may do away with the point or spurs 56 altogether, if desired. According to the invention, also, the disc 26 may be made from other suitable materials.

Figure 6A:
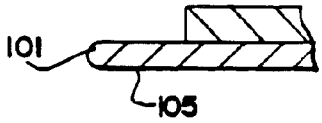
FIGS. 6A and 6B are greatly enlarged fragmentary sectional views of the contours of modified forms of the edge of the locating disc of the invention.
Figure 6B:
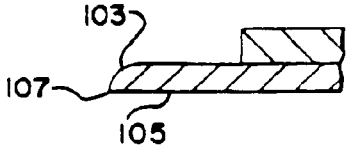

At any rate, and referring now to FIGS. 6A and 6B, the outer margin 54*a* of the disc 26 may be formed as shown. Here, in FIG. 6A, an outer surface 101 is shown to be rounded so that no sharp edge is presented. An alternative form of disc edge is shown in FIG. 6B, wherein a rounded surface 103 is formed on only that portion of the disc which will contact the surface acting as a guide. The bottom surface 105 is flat and the corner 107 is sharp. Bearing in mind that the disc will be somewhat inclined in use because of handle axis inclination, the sharp edge 107 will be spaced slightly away from the actual wall contact surface and the edge 103 will not damage such a surface.

Referring again to FIGS. 2–4, the applicator pad generally designated 28 is shown to include a main body portion 70, and a cylindrical wall 72 defining a center opening 74 which may but need not extend entirely through the pad 28. The shape of the body 70 is generally flat on one surface and somewhat convex on the other surface such that, when the pad is viewed in cross-section, its axially outer, paint-applying or working surface 76 has a generally outwardly dished or bowed contour.

The pad 28 includes a bonded-on backing stiffener generally designated 78 which may include a center bearing 80 in the form of a grommet or the like (best shown in FIG. 9), a radially outer shoulder 82 and a generally radial outer marginal flange 84. This flange 84 has a sharp outer edge 85 (FIG. 9) to insure that the paint trim edge is sharp. If a center bearing is not provided in grommet form, the backing stiffener may have increased the lines in its center section. The flange 84 provides increased radial stiffness relative to an arrangement with a tapered or beveled outer edge. The contour of the pad body 70 is also such that a foam lip 86 of a thin cross-section is formed where the marginal flange 84 meets the body 70 adjacent the outermost edge of the pad.

Referring now in particular to FIG. 4, one optional but sometimes preferred form of pad is illustrated, namely, a pad that includes a plurality of wells or cylindrical bores 92 through which paint can enter and be retained in the foam pad. The wells 92 terminate at inner end faces 94 which are spaced well apart from the working surface 76. In use, it has been discovered that, by reason of using thixotropic paints which will resist dripping, capacity of the pad can be increased by providing a number of these wells or bores in the foam pad. In one embodiment, about 640 such wells or passages, each of 0.090 inches in diameter provided excellent paint retention and application rates. The surface of the paint pad can also be flocked, if this is desired for any reason.

Referring again to FIGS. 3 and 4, it will be noted that since the larger and smaller spindles 42, 46 are eccentrically disposed, i.e., are not coaxial, that the rotary axis of the guide disc 26 is different from that of the applicator pad 28.

As a consequence of this, when the handle 24 is rotated about its own axis, the edge of the locating disc 26 moves relative to the center line axis go the pad, moving the pad 28 closer to or farther away from any reference surface contacted by the outer edge of the locating disc 26.

As indicated in FIG. 1, a plurality of spaced apart indicia (25*a*, 25*b*, 25*c*), for example, are provided at various clock or compass points of the backing plate so that the user may readily select the distance from which he wishes to space the pad edge from any given reference surface. If, in use, the trim edge is determined to be too far from or too close to the reference surface, a simple rotation of the handle will change the setting by moving the pad center towards the edge of the guide disc 26 that will contact a perpendicularly related guide surface. Inasmuch as the application pad is a pad which rotates relative to the handle, the handle does not normally undergo rotation during application of paint by the edger, and thus the location of the hard or trim edge is maintained in its desired relation to the wall.

While the paint applicator of the invention may be effective to apply a band of paint in the absence of a guide surface, it is normally so utilized. Accordingly, as used herein, and in the claims, the expression "perpendicularly related surface, guide surface, or words of like import is meant any surface that will serve this purpose. In the case of painting an inside corner, this will be an adjacent wall or ceiling. However, guide surfaces might be formed by a perpendicular surface of a small extent, such as a piece of trim, wainscotting, a chair rail, a baseboard or the like.

Figure 9:
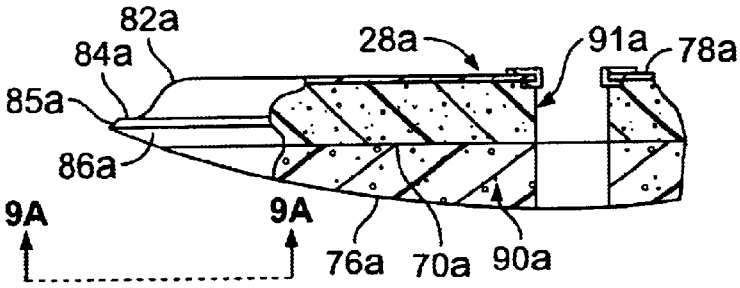
FIG. 9 is an enlarged fragmentary view of the pad of FIG. 8, illustrating the laminated construction of the pad and the construction of the outer edge of the pad.
Figure 9A:
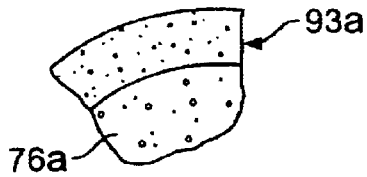
FIG. 9A is a fragmentary bottom plan view of the outer margin of the pad of FIG. 9 taken along lines 9—9 thereof.

Referring now to another feature of the invention, FIG. 9, 9A show a modified form of pad generally designated 28*a* and including a backing stiffener 78*a*, a radially outer shoulder 82*a*, a generally radially extending outer margin 84*a* and a sharp outer edge 85*a*. The pad body 70*a* likewise includes a small lip or edge 86*a* where the backing stiffener margin 84*a* meets the pad body 70*a*. In FIG. 9, 9A, the body 70*a* is shown to comprise two layers laminated together, a largely exposed or axially outer body portion 90*a* and an axially inner portion 91*a*. The inner portion 91*a* is arranged so that, as shown in FIG. 9A, a small exposed margin 93*a* can be seen when the pad is viewed looking at the working surface 76*a*. The remainder of the working surface 76*a* comprises the axially outer, working surface 76*a* of the body 90*a*.

In the preferred form, the axially outer body portion 90*a* is a larger pore open cell foam, while the inner body portion 91*a* is made from a much smaller size, generally stiffer and less absorbent foam. In a form which has proven successful in comparative testing, the more coarse material had 25–35 pores per lineal inch ("ppi"). In another specimen, this coarser foam was made from a polyester material having cells of multiple sizes. A finer, somewhat more dense, stiffer material having comprising the outer margin and having a porosity of about 70 ppi was very satisfactory.

As an option, the exposed or working face of any of the pads of the invention may be covered by a flocking material of a type known to those skilled in the art, and in some applications, including those where a somewhat different paint texture is desired, a flocked pad is able to be operated successfully.

Referring now to the use of various forms of the inventive edger apparatus of the invention, and in particular to using the paint edger apparatus 10, advantage is taken of the relatively great volume of the pad 28, its dished or convex shape, and in some cases, its composite or two-layer laminated construction. FIG. 10 shows that, with the pad 28 positioned so that one portion of its edge is arranged to create a trim edge 20, the handle and pad rotation axes are inclined with respect to the surface 14 to be painted.

Thus, as shown in FIG. 10, with a predetermined pressure applied to the pad by tilting the handle axis, a portion of one side of the working surface 76 forms a contact area 23 with the surface 14 to be painted. The remainder of the pad, while filled with paint, does not contact an adjacent surface. Subsequently, as the pad is advanced along the surface 14 to be painted in the direction shown by arrow "A", the portion of the pad 28 containing a reserve of paint rotates so as to become a part of the contact area 23, thus applying paint to the surface.

A sharp trim edge 20 is created on one side of the pad 28 by the combination of pad manipulation, the sharp edge 85 of the pad backer 78, the thin cross section of the pad, and in the preferred instances, the fact that the outer pad margin is formed from the layer of foam material which has a finer porosity. Because the working surface 76 of the pad 28 is convex, as illustrated, the thickness of the paint layer along a locus parallel to but spaced from the trim edge is much less than that adjacent the trim edge 20. This area is the feather edge 21. Consequently, after the trim edge 20 has been applied, if several minutes or more elapse before the remainder of the room can be painted, a follow-on application of paint will overlap and blend in with the feather edge 21, so that the whole wall will be free from clear ridge lines or marks where the feather edge meets the remainder of the paint coating. Many instruments of the prior art created a thick, sharp edge instead of a feather edge at the junction of these areas.

Because of the rotary action of the pad, and its contoured outer surface, a significant length of wall or other surface can be painted without replenishing the supply of paint in the applicator pad. The dished or convex surface of the pad permits controlling the width of the application area relative to the pad surface by inclining the handle axis to the desired extent. Thus, the preferred orientation of the pad is such that the handle is inclined significantly towards the trim edge and slightly backwards in relation to the direction along which the applicator pad is moving. This also enables a relatively thicker film of paint to be held in front of the application surface and moved forward as the pad moves along.

Figure 8:
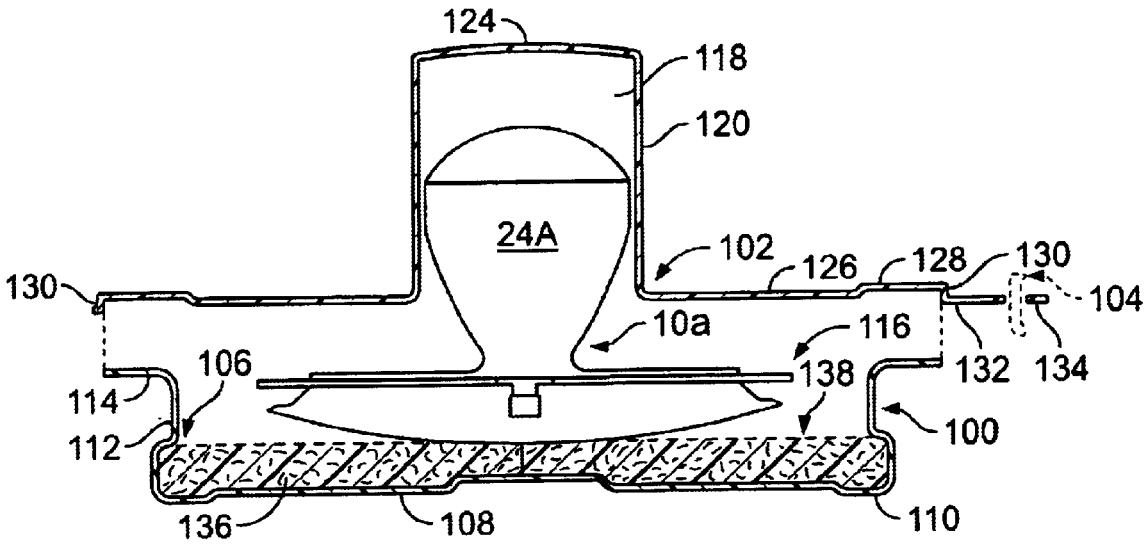
FIG. 8 is a vertical sectional view of one preferred form of paint application pad of the invention, and showing the pad in relation to an associated tray and tray cover.

FIG. 8 shows a form of the invention which incorporates some or all of the features described above, and, in addition, is shown in a cooperative relationship with one form of special purpose paint tray generally designated 100, having a specially formed tray cover and handle retainer generally designated 102 and adapted to be positioned on a display rack as by a wire hook or like holder generally designated 104.

Referring now to the tray 100, it is shown that this unit preferably includes a thermoformed plastic body portion generally designated 106 which comprises a bottom wall 108, an annular contoured outer margin 110 providing leg or support surfaces, a slightly reduced diameter sidewall portion 112, and an outwardly extending lip portion 114. The surfaces forming the lip 114 define an enlarged diameter center opening generally designated 116 for receiving the pad 28*a* of a paint edger apparatus generally designated 10*a*. The apparatus 10*a* is substantially identical to any one form of its counterparts shown in FIGS. 1–4. The handle portion 24*a* of the unit fits within a cylindrical space 118 formed by side and top walls 120, 124 on the cover unit 102. This cover unit 102 also includes a main cover panel 126 having an annular contoured shallow locking recess 128 terminating in undercut or inturned locking flange 130 which cooperates with the outermost edge of the lip or flange 114 to position the cover and the pad in releasably interlocked relation. A tab 132 includes an opening 134 for receiving the display hook 104 when the apparatus is presented for sale.

A novel feature of the combination paint tray and display unit 100 is a tray insert 136 which is made of a foamed plastic or like material.

According to the invention, as will be described elsewhere herein, an interior or a reservoir portion generally designated 138 for thixotropic paint is formed by the sidewalls 112, the bottom wall 108 and the contoured annular surfaces 110. In use, when paint is poured over the foam insert, the saint is held in its desired location in the tray 100. According to the invention, the sidewall portion 112 is of slightly reduced diameter relative to the lowermost sidewall portion 113, resulting in the creation of a shoulder 115 between these surfaces. This inwardly directed shoulder serves as a retainer or holddown surface relative to the outer margins of the foam insert 136. Other forms of retainers or holddowns suitable for this purpose include inwardly extending bosses or the like, folded over or similar flanges formed separately or from a portion of the material comprising the sidewall, or simply from dimensioning the insert 136 such that it is a snug fit within the reservoir 138. The other means for retaining the insert in position will occur to those skilled in the art, it being understood that the interference fit method of achieving pad retention is not as effective with pure cylindrical sidewall surfaces than would be the case if the interference were achieved by the shoulders described, by a reverse taper on the counterpart surfaces of the sidewalls and the pad, etc.

The foam insert 136 provides advantageous transfer and anti-spill functions. The mesh of the foam insert 136 may depend on the characteristics of the paint, but a relatively coarse foam such as a foam having approximately 3–10 pores per lineal inch has proven successful.

Figure 11:
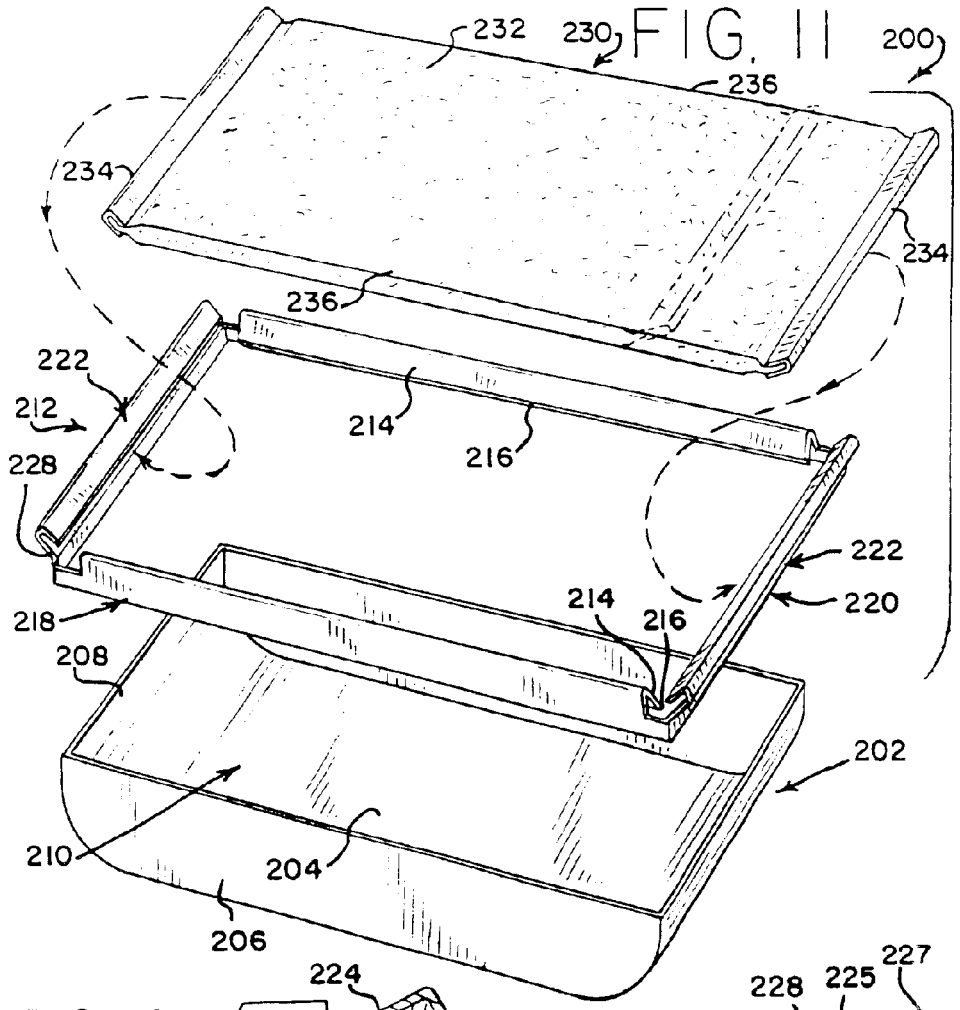
FIG. 11 is an exploded perspective view of another form of paint tray made according to the invention.
Figure 12A:
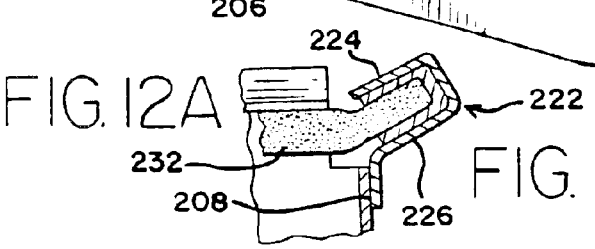
FIG. 12A is an enlarged fragmentary sectional view of a portion of the tray cover of FIG. 12 and its retainer.
Figure 12B:
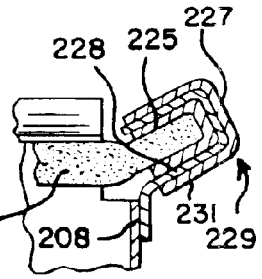
FIG. 12B is an enlarged fragmentary sectional view of a portion of another form of paint tray cover and its retainer.
Figure 12:
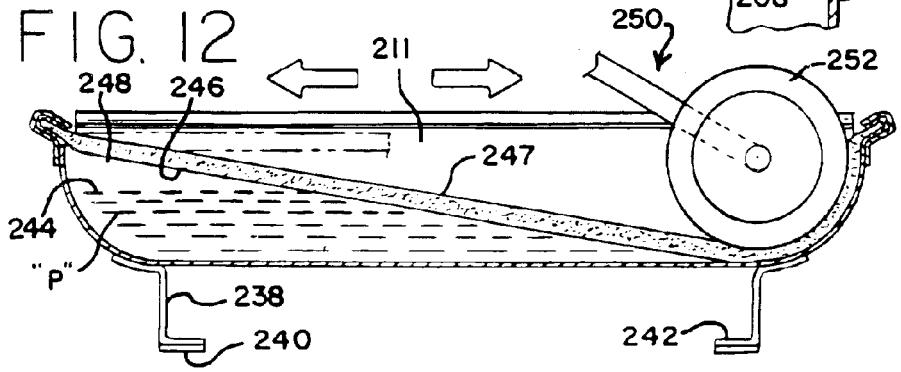
FIG. 12 is a sectional view of the paint tray of FIG. 11, showing a paint roller in its position of use in the tray.

Referring now to FIGS. 11–12A, a modified, more all-purpose paint receptacle assembly generally designated 200 is illustrated. This unit is shown to comprise a main tray portion generally designated 202 and an interior defined by bottom, side and end walls 204, 206, and 208, respectively. These walls have upper margins which collectively define an access opening generally designated 210. Another element of the assembly is the cover retainer generally designated 212 and shown to include a pair of opposed side edge retainer flanges 214 each having outer edges 216 that are more closely spaced apart from each other than are the side walls 206, thus overlapping the side walls to reduce the effective size of the access opening 210 by a small amount. The retainer unit 212 also includes side and end walls generally designated 218, 220 which are arranged to be press fit over the upper margins of the side and end walls 206, 208 of the tray 202. The upper portions of the retainer end walls 220 are folded somewhat back on themselves to present a pair of opposed U-channels generally designated 222 having upper and lower flanges 224, 226 (FIG. 12A) closely spaced apart from each other and preferably being made from a resilient material such as steel or the like. A slot or opening 228 (FIG. 11) is formed between the flanges 224, 226.

Referring again to FIG. 11, the cover element generally designated 230 is the other principal element of the receptacle assembly 200. The cover element comprises a single sheet 232 of a flexible, open cell, paint-absorbent material having clips 234 on its opposed ends, a and presenting outer edges 236 that are spaced apart substantially the same distance as the width of the access opening 210 of the container. The cover 232 is of slightly increased width relative to the spacing between the edges 216 of the side wall retainers.

According to the invention, the foam cover, which is preferably made from a polyester material, has about 3–10 pores per lineal inch. When this pad is stretched to the solid line position of FIG. 11, the end clips 234 are snapped into the space 228 between the opposed flanges 224, 226 (FIG. 12A) of the U-channel assembly 222 with a snug but releasable fit. This extends the cover by an amount sufficient to tension it, but not enough to prevent its being depressed to and below the surface of paint in the tray.

FIG. 12B shows that the clips 234 may be received between the upper and intermediate flanges 225, 227 of an E-clip generally designated 229. The space between the intermediate flange 227 and the lower flange 231 to the E-clip is snugly received over the inclined flange 228 extending upwardly and outwardly from the end wall 220 of the retainer 212. In this system, the end clips on the tray cover 230 permanently retain the cover ends but releasably engage the retainer flanges. This simplifies handling relative to the embodiment of FIG. 12A.

In use, as shown in FIG. 12, a charge of paint "P" is added to the tray 202 through the access opening 210 of the unit either by pouring it through the foam cover, or by filling the tray and then snapping the end clips 214 of the cover unit into place. In the form of tray shown in FIG. 12, legs 238 having pads 240 on the bottom surfaces of tray feet 242 are used to position the tray and prevent unintentional movement thereof.

The level of the paint "P" within the tray 202 is such that the upper surface 244 of the paint is spaced from the lower surface 246 of the cover 230 by a head space 248. In this condition, even if the tray is jostled or tilted momentarily, the cover is effective to retain the paint within the tray. When it is desired to use the apparatus as intended, a paint roller generally designated 250 has its absorbent sleeve portion 252 filled with paint by pushing the sleeve 252 down on the upper surface 247 of the foam cover sheet 232. This action fills the roller sleeve 252 with paint which passes through the slightly porous cover 232 in an amount sufficient to wet the roller without overloading it or rendering it susceptible to dripping. The roller may be passed back and forth one or more times as shown by the arrows in FIG. 12 if this is necessary.

In keeping with the invention, the ability of the roller to engage and roll along the surface of the foam material with which it is in contact without overfilling the roller with paint inherently controls the amount of paint transferred to the roller. This does away with the need for a rollout or squeegee area in the pan.

In prior art paint trays, the capacity is limited, as a practical matter, by the need to provide a rollout or squeegee surface to prevent over-impregnation of the roller with the liquid paint. According to the present invention, advantage may be taken of the increased volumetric capacity of the paint tray to minimize the need for repeatedly filling the tray with only a small amount of paint.

When replenishment of the paint supply is required, the paint may simply be poured into the tray through the cover element formed from a foam or non-woven fabric, paint absorbent material. The preferred level of paint is shown in FIG. 12 as being spaced slightly beneath the surface of the insert cover so that the paint reservoir is largely full, but that some free volume or head space is provided between the bottom of the insert and the top of the liquid level. This permits the paint to move to one end of the tray or the other as the insert displaces some of the paint while being itself filled with paint for transfer to the roller.

A paint tray made according to this concept can accordingly hold a larger reserve of paint requiring less frequent fillings, is resistant to spillage because of the insert cover, and provides a more uniform application of paint to the roller or pad. In this connection, it will be noted that a rotary pad 28 of the type described herein may also be used with such a tray 200, with paint being applied merely by sliding or rolling the pad along the surface of the cover insert pad 222.

Figures 13, 13A:
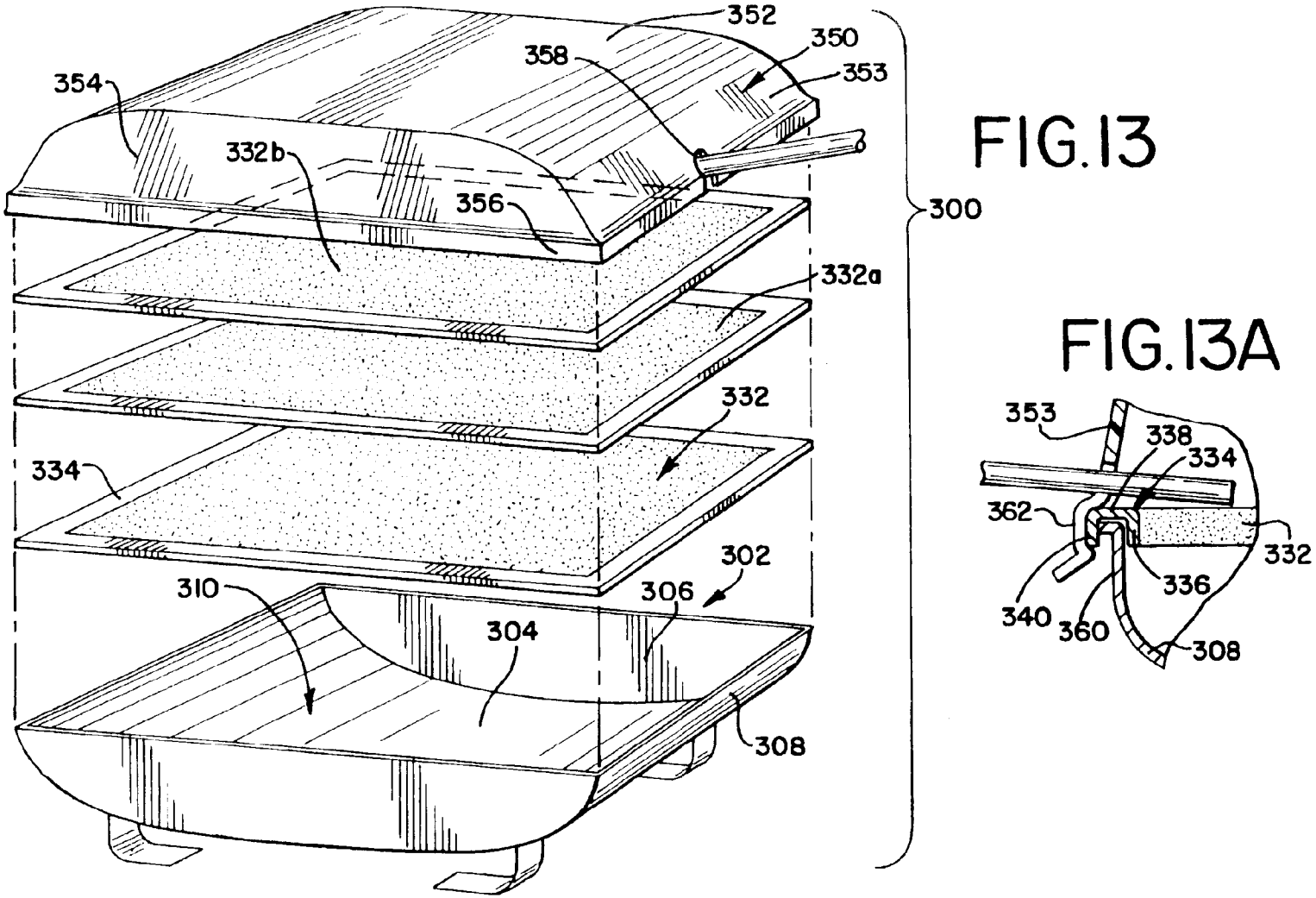
FIG. 13 is an exploded perspective view showing the paint tray, one of several foam pads for the paint tray, and an impermeable cover, preferably made from a clear material, for the paint tray.
FIG. 13A is a greatly enlarged fragmentary vertical sectional view showing the manner in which any one of the foam pads and the impermeable cover fit over the paint tray of the invention.

Referring now to FIGS. 13 and 13A, another embodiment of the invention is shown. Here, a further modified, all-purpose paint receptacle generally designated 300 is shown. This includes a main tray portion generally designated 302 and having bottom, side, and end wall portions designated 304, 306, 308, respectively. These walls have upper margins which collectively define an access opening generally designated 310.

Other elements of the invention are one of a number of foam pads generally designated 332, 332*a*, and 332*b* and an impermeable plastic cover generally designated 350. The cover includes a top panel 352, and end wall 353, sidewalls 354, and a bottom marginal section generally designated 356 which surrounds the bottom or skirt portion of the panels 352, 353, and 354 in a manner to be detailed herein.

Referring again to one of the pads, typically a unit 332*a*, this foam pad extends across the opening 310 and includes a pair of opposed, front and rear U-clips generally designated 334, and also includes a sidewall portion 336 bonded to the foam 332, a closed transverse bight piece 338 and an outer margin 340. Collectively, these pieces enable the foam pad 332 to be secured over the opening 302.

The transparent cover unit includes a flexible bottom flange generally designated 356, having several elements. At the bottom is a slightly flexible, tapered or beveled pilot surface 360, above which is a groove 362 which fits over the outside margin 340 of the clip 334. Another important feature of the invention is a small opening 358 formed in an end wall 353. This opening 358 permits the shank portion 366 of a handle to project therethrough, but substantially closes off the remainder of the opening.

Alternate forms of the foam element 332 are shown as 332*a* and 332*b*, being identical to their counterpart 332, except for the fact that the foam porosities of the foam used to make them are different.

By way of example, the porosity of the coarse bodied foam is one which may have from three to fifteen pores per lineal inch (ppi). A unit such as this may function well with very thick or highly thixotropic paints. A medium element, for an average paint, is shown as 332*a*. This unit has fifteen to thirty pores per inch, by way of example. The third element, 332*b* may contain thirty to fifty or sixty pores per inch (ppi), and is suitable for thin paints and/or stains. In use, only one of the elements 332 is selected for use with the paint, and the others are set aside.

A paint tray according to the form of invention shown in FIGS. 13 and 13A may include the form of retainer shown in FIGS. 11–12*b*. In the alternative, the form of attachment shown in FIG. 13*a* may be used, and the sides may or may not be clipped onto the tray. The foam thickness of the element shown ranges from slightly over an eighth of an inch (0.125 inches) to ¾ of an inch (0.750 inches), preferably having a thickness of 0.0200 to 0.0250 inches.

Depending upon the width of the tray and the associated roller, the margins extending along the sidewalls 306 of the tray may be bonded to the edge of their frames, or they may be retained in place merely by being stretched, and having the type of frame shown at 212 in FIG. 11. The paint may be placed in the tray and then the tray covered with the foam element. The roller picks up the paint when the roller depresses the pad into contact with the paint lying beneath it in the tray.

When it is desired to paint, a further advantage of the form of tray shown in FIGS. 13 and 13A is the cover, preferably transparent, shown as 350 in the illustration. By snapping the cover over the tray with the foam pad, it is possible to greatly delay the drying of the paint. This makes it possible to set aside the paint roller and tray unit from as little as an hour or so to a time of two or three days or more, all without the need to clean the roller.

Figure 14:
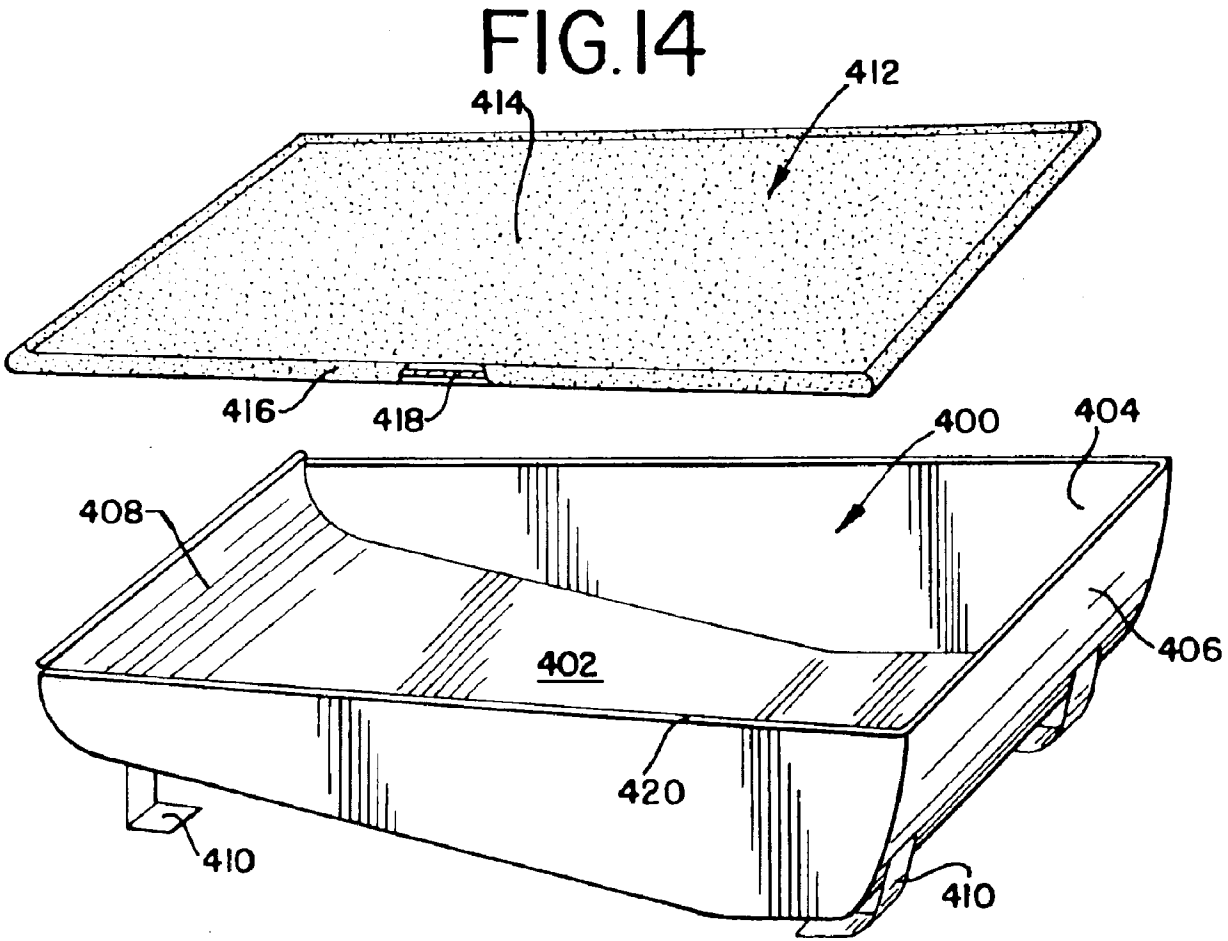
FIG. 14 is an exploded perspective view, with a portion broken away, showing a paint tray with a foam-type pad covering the opening and made according to the invention.
Figure 15:
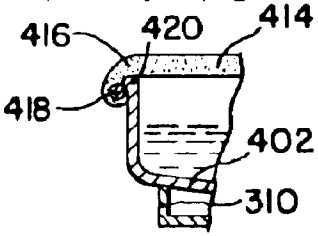
FIG. 15 is a greatly enlarged fragmentary vertical sectional view, showing the manner in which the elastic band is embedded in the foam cover.

FIGS. 14 and 15 illustrate another form of the invention. Here, a tray generally designated 400 is shown. This tray 400 includes a bottom wall 402, sidewalls 404, and front and rear end walls 406, 408. Feet 410 may be provided as indicated. Covering the open exterior of the tray 400 is a pad generally designated 412 and shown to include a foam center portion generally designated 414, and an outer margin 416, including an embedded elastic band 418. In this embodiment, the top edge of the tray terminates in a bead 420 which provides an enlarged diameter part of the tray for the elastic band to hook on, and this ensures that the pad will function as desired, i.e., not come off in use.

FIG. 15 shows the pad with the margins 416 and the elastic portion gripping beneath a rolled edge or bead 420 of the tray. The main portion 414 of the pad lies above the surface but may in use be depressed therebeneath by the action of the roller, as shown in FIG. 12, for example. This form pad covering for the unit is a very economical aspect of the invention.

Figure 16:
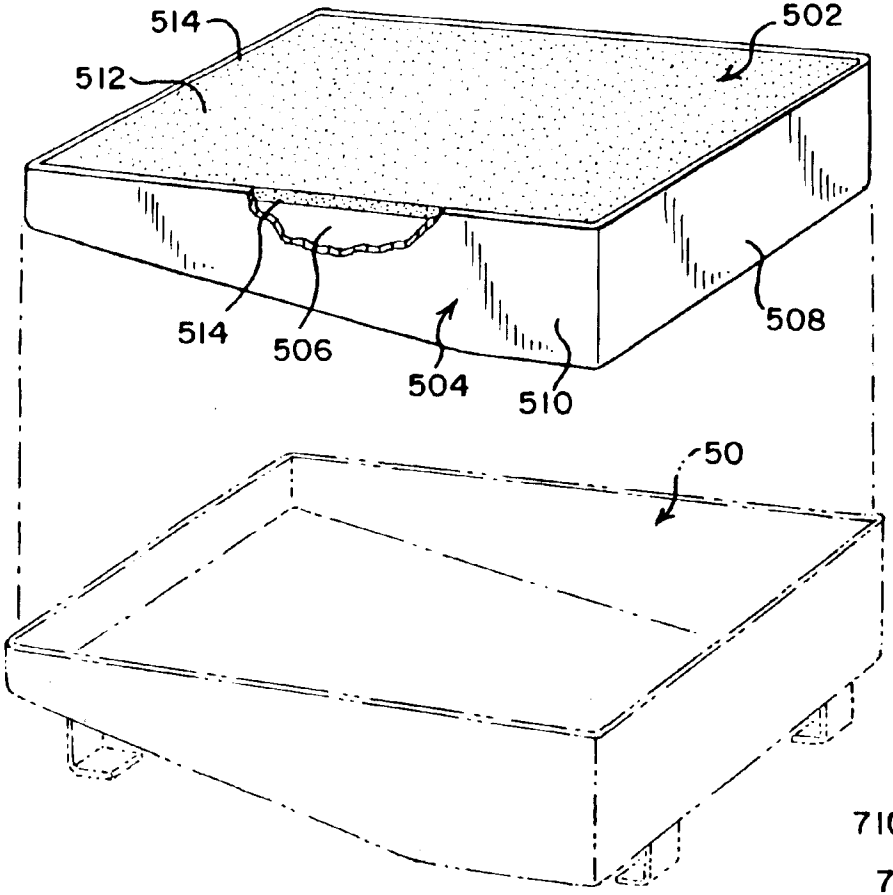
FIG. 16 is a perspective exploded view, showing a paint tray insert made of a polyethylene material with a foam cover over the top thereof, with an associated metal tray being shown in phantom lines.

Referring now to FIG. 16, another form of the invention is shown. Here, a tray generally designated 500 is shown in phantom lines. This tray 500 is adapted to receive an insert generally designated 502, which is shown to include an insert tray portion generally designated 504 having a bottom wall 506, end walls SOS, and sidewalls 510. The foam pad 512 overlies and closes off the opening.

The pad 512 is bonded, as at 514, to the tray insert 502. According to this form of the invention, a plurality of inserts may be provided, and discarded once they are used. The tray or retainer generally designated 500 is suitable for reuse any number of times without the necessity of cleaning it. The bond is shown at 514 as extending along the sidewall; however, the bond may also be formed at the end walls only, depending on the amount of stretch in the pad 512 and the width of the tray insert 502.

Figure 17:
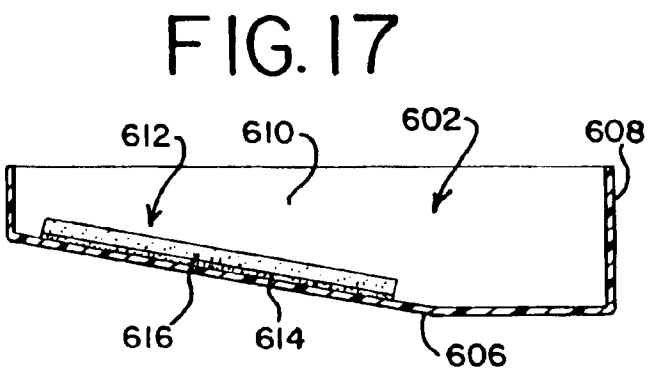
FIG. 17 is a vertical sectional view of another form of tray liner made according to the invention, and having an insert section of foam bonded to a bottom surface of the tray.

FIG. 17 shows a still further modified form of the invention wherein a tray insert 602 is also used. The tray includes a front wall 60*a*, a bottom wall 90G, and a sidewall 610. According to this form of the invention, a foam pad generally designated 612 is attached as by a bonding layer 614 to the bottom wall 608 of the tray insert. In this form of the invention, the provision of the foam pad on the bottom of the tray insert improves the rollout and makes it easier to manipulate the roller. The major part of the roller can be dipped in the paint and rolled over the pad to crease an increased smoothness and evenness of the paint application.

Figure 18:
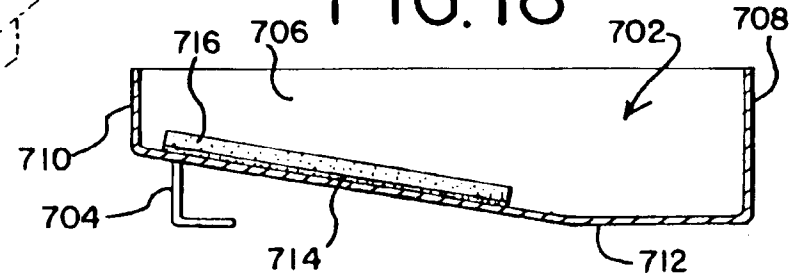
FIG. 18 is a vertical sectional view of a metal tray according to the invention, showing a piece of foam bonded to a portion of the bottom surface thereof.

FIG. 18 is similar to FIG. 17, except that it shows a tray generally designated 702 having a pair of legs 704. The tray 702, which is made from a metal material, includes a front end wall 708, a rear end wall 710, a sidewall 706, and a bottom wall 712. A layer of adhesive 714 serves to bond a pad of foam 716 to the bottom of the tray 712. In use, this tray functions the same as that of its counterpart in FIG. 17, except that it is a integral part of the tray rather than the insert unit.

According to any form of the inventive paint tray or receptacle concept, such receptacle, when supplied with an insert of the type just described, is not susceptible to spilling when filled with thixotropic paint. The apparatus also demonstrates a very significant improvement in applying paint to the working face of the pad. A uniform pressure against the foam surface of the insert is all that is required to cover the working face of the pad and impregnate it evenly and effectively. No rubbing or squeezing out action such as that required when removing excess paint from a roller with a conventional paint tray, is needed. The tendency of the paint to distribute itself equally between the two foam elements, one in the insert and one forming the pad, is believed to be a novel and highly effective way of making a drip-free but high capacity exchange between the reservoir and the applicator. As the paint supply in the receptacle diminishes, the insert may simply be pushed farther down and the pad is effectively loaded in an even, non-drip manner.

The preferred paint tray of the invention will hold up to about one gallon of paint, some four times as much as most common trays. This in and of itself is not disadvantageous because the foam pad that covers the upper surface resists slopping, splashing and spilling. When the roller is passed over the sponge foam pad, the roller becomes precisely loaded with just the right amount of paint for a smooth even application. This occurs when the roller is passed evenly with one quick stroke across the element, rather than the constant back and forth motion required with paint rollers being rolled up against the contoured bottoms of conventional paint trays.

By having the roller loaded evenly all the way around, it is not necessary to work out the paint on the wall. Accordingly, the roller may be stroked back and forth without having to perform the additional operation of applying paint and then spreading it while rolling the paint out. With those embodiments of the invention using the foam cover, the paint prematurely drying is avoided. Instead, the paint creates a more consistent job from start to finish. By running the paint through the foam, which acts as a filter, the painter can see and remove debris before it gets on the wall. The element keeps the paint wet and makes cleanup fast and easy.

Referring now to another embodiment of the invention, those embodiments that use the cover, particularly a clear cover, allow for a standard paint roller, paint pad or brush to be stored and kept useable for up to several days. In addition, the applicator may be set down on top of the foam pad without becoming soaked and sloppy. The element filters out debris, leaving it at the bottom of the tray. Hence, it is easy to discard after the job is finished, and does not go on the wall or ceiling. Consequently, no time is spent trying to roll out the roller to obtain the smoothest, most uniform coat on the roller. This is accomplished by passing the paint through the pad directly on to the roller.

It will thus be seen that the present invention provides a paint edger with an improved pad and precision positioning adjustment having a number of advantages and characteristics including those expressly pointed out here, and others which are inherent in the invention. An illustrative embodiment of the product of the invention having been shown and described, it is anticipated that variations to the described form of apparatus will occur to those skilled in the art and that such modifications and changes may be made without departing from the spirit of the invention, or the scope of the appended claims.

What is claimed is:

1. A paint applicator pad constructed and arranged to be rotated in use to apply a band of paint to a first surface lying adjacent a second perpendicularly disposed surface, said band of paint having a sharp trim edge portion and an opposed feather edge portion of reduced thickness, said pad having a center opening receivable in use and separated by a working clearance from a spindle, said pad being of circular form in plan and having an applicator pad body portion made from a paint absorbent, open cell foam material, said pad having a generally convex exterior working face and having laminated to its opposite face a relatively stiff body backing portion, said backing portion and said applicator pad body portion having outer margins constructed and arranged so as to meet adjacent the radially outermost margin of said backing portion, said body portion and said backing portion being radially co-extensive, said body portion joining said backing portion at said outermost margin of said backing portion to define a trim edge forming portion of said applicator pad body.

2. A paint applicator pad constructed and arranged to be rotated in use to apply a band of paint to a first surface lying adjacent a second perpendicularly disposed surface, said band of paint having a sharp trim edge portion and an opposed feather edge portion of reduced thickness, said pad having a center opening receivable in use and separated by a working clearance from a spindle, said pad being of circular form in plan and having an applicator pad body portion made from a paint absorbent, open cell foam material, said pad having a generally convex exterior working face and having laminated to its opposite face a relatively stiff body backing portion, said backing portion and said applicator pad body portion having outer margins constructed and arranged so as to meet adjacent said margin of said backing portion, said body portion and said backing portion being co-extensive, said body portion joining said backing portion at said outer margin of said backing portion to define a trim edge forming portion of said applicator pad body, said applicator pad body comprising two layers of foam material, one layer having a coarser porosity and the other layer having a finer porosity, with said finer porosity layer having a portion lying radially outwardly of said layer having said coarser porosity.

3. A composite rotary pad for forming a sharp trim edge on a band of paint applied to a first surface and to form a feather edge opposite said trim edge, said composite pad including a backing portion made from a stiff but resilient material and having a generally flat, center section and presenting a circular appearance in a plan, an outer shoulder including an at least partially axially extending portion and a radially outwardly extending flange portion, said radially outwardly extending flange portion terminating in a sharp outer edge, a first body portion being a layer made from a paint-absorbent, open cell, resilient foam material of a very fine pore size, said layer including a radially outer, axially tapered margin joining said radially outwardly extending flange portion, and a second body portion made from a relatively more coarse, paint-absorbent, open cell flexible foam material, said first and second body portions comprising axially inner and outer layers arranged to form a continuous convex paint application surface.

4. A pad as defined in claim 3 wherein said center section of said backing portion includes a center bearing adapted to be guidingly received over a spindle on an associated handle unit.

* * * * *